US005079539A

United States Patent [19]

Hatori

[11] Patent Number: 5,079,539

[45] Date of Patent: Jan. 7, 1992

[54] STORAGE CASE FOR COMPACT DISCS AND VIDEO CASSETTES

[76] Inventor: Shigeru Hatori, Masters Home 102, 6-4, Ikejiri 1-chome, Setagaya-ku, Tokyo, Japan

[21] Appl. No.: 509,626

[22] Filed: Apr. 13, 1990

[30] Foreign Application Priority Data

Apr. 13, 1989 [JP] Japan ..... 1-91797
Sep. 28, 1989 [JP] Japan ..... 1-253058

[51] Int. Cl.[5] ..... G08B 13/14
[52] U.S. Cl. ..... 340/568; 377/17
[58] Field of Search ..... 340/568, 674; 200/61.41, 61.59, 61.19; 377/17, 26, 8; 360/137

[56] References Cited

U.S. PATENT DOCUMENTS 4,859,993 8/1989 Kagami et al. ..... 340/674

*Primary Examiner*—Glen R. Swann, III
*Assistant Examiner*—Thomas J. Mullen, Jr.
*Attorney, Agent, or Firm*—Knobbe, Martens, Olson & Bear

[57] ABSTRACT

A storage case comprising a case body having two or more storage parts into which CDs or recorded cassettes are inserted respectively, sensors detecting said CDs or said video cassettes taken out from said storage parts, a counter integrated by signals from these sensors, and an indicator part indicating an integrated value from this counter. This structure enables said storage itself to manage the rental of said CDs or said video cassettes, which leads to a very easy confirmation of the rental volumes without using conventional technical know-hows such as unopened seal or the likes.

2 Claims, 6 Drawing Sheets

STORAGE CASE FOR COMPACT DISCS AND VIDEO CASSETTES

BACKGROUND OF THE INVENTION

The present invention relates to a case for storing a relatively small number of CDs (Compact Discs) or recorded video cassettes, and in particular, relates to a technical know-how which ensures to confirm the number of rented CDs or video cassettes and to confirm the renting will of the renters.

In this kind of recorded video cassette rental system, in general, a large number of video cassettes whose fancy cases are access-free are exposed on the display racks of a rental shop, and renters who are members of the rental shop judge the recorded contents of the video tapes thereby and rent the video cassettes at the counter of the rental shop.

In said rental system, however, a large floor area is required for display and the management of the rental management informations is complicated.

As a result thereof, various automatic rental apparatuses storing 30 to several tens of video tapes have been proposed as a shopless rental system.

A so-called storage case has been also proposed wherein a storage case storing several sealed video tapes is deposited with a customer for about a week and a rental fee is collected only for the opened video tapes.

Since the rental system using said automatic rental apparatuses, however, requires an electronic management means of the number of rental volumes, date of issue and others, the mechanism is complicated, large-scale and high-cost. In addition, if such an automatic rental apparatus is installed as an unmanned shop, there are also risks of burglaries, damages or the like, which finally requires a rental manager operating said automatic rental apparatus.

In said storage case of conventional type, when previously opened video cassettes are to be deposited with another customer, it is necessary to apply unopened seals to the opened video cassettes again, and it is difficult to utilize the video cassettes effectively.

In recent years the rental of CDs is increasingly used instead of that of analog records, but there are no storage cases for CDs.

In consideration of the foregoing, the object of the present invention is to provide a technical know-how which makes it possible to confirm the number of the video cassettes rented from a storage case very easily without applying unopened seals or the like to CDs or video cassettes.

SUMMARY OF THE INVENTION

A summary of the disclosure as contained in this application is described as follows:

A storage case comprising a case body having two or more storage parts into which CD or recorded video cassettes are inserted respectively, sensors for detecting said CDs or said video cassettes taken out from said storage parts, a counter for being integrated by signals from these sensors, and an indicator part for displaying an intergrated value from this counter.

This construction enables said storage case itself to manage the rental of said CDs or said video cassettes, which leads to a very easy confirmation of the rental volumes without using conventional technical know-hows such as unopened seal or the like.

By providing an ejector in said storage parts which energizes said CDs or said video cassettes in the direction of the upper side, and by outputting a signal from said sensors when said video cassette has been taken out by a predetermined amount from the highest point in the direction of the upper side, said CDs or said video cassettes will not be counted when they are only ejected, which ensures the rental shop more clearly to confirm the renting will of the renter.

Said sensors in said storage parts comprise a first sensor for detecting said CDs or said video cassettes taken out from a stored condition, and a second sensor for detecting the rental storage number of the CDs or the video cassette stored in an initial condition, and by intergrating the counter using the logical multiply of a latch signal based on a storage detecting signal from said second sensor and a take-out detecting signal from said first sensor, the error count of the rental volumes due to malfunctions of said first and second sensors in the storage parts in which said CDs or said video cassettes have not been stored in an initially installed condition, can be prevented, and the reliability of the rental management can be improved.

DESCRIPTION OF THE PREFERRED EMBODIMENTS

[Embodiment 1]

This Embodiment 1 has a body 1 of box structure, and an upper lid 2 covering the opening of this body 1 and having its supported side end. On the inner side of said upper lid 2 an inner pocket 8 having rental forms and others therein, and on the outer side of said upper lid 2 a carrying handle 5 is fixed. This handle 5 makes this storage case portable wherein the upper lid 2 is fixed to the body 1 with a retaining pawl mounted at the open end of the upper lid 2.

Figure 1:
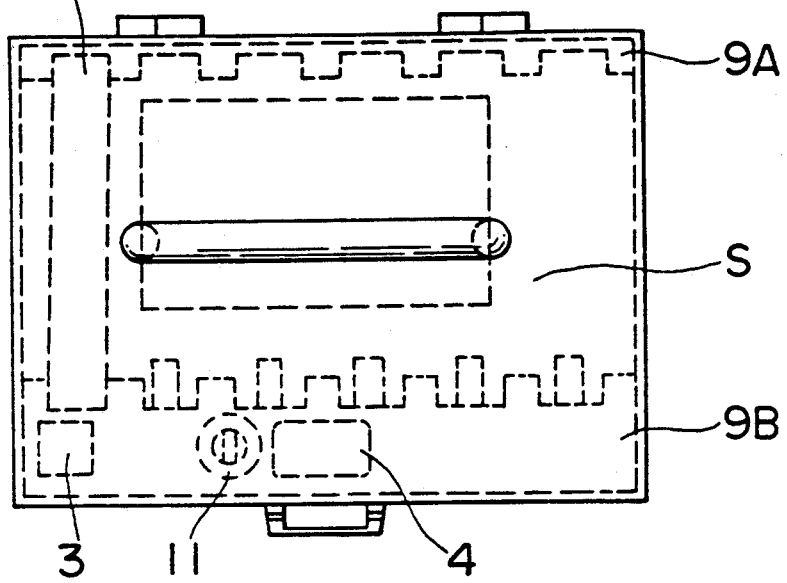
FIG. 1 is a plan view showing the storage case of the preferred embodiment 1 according to the present invention.
Figure 2:
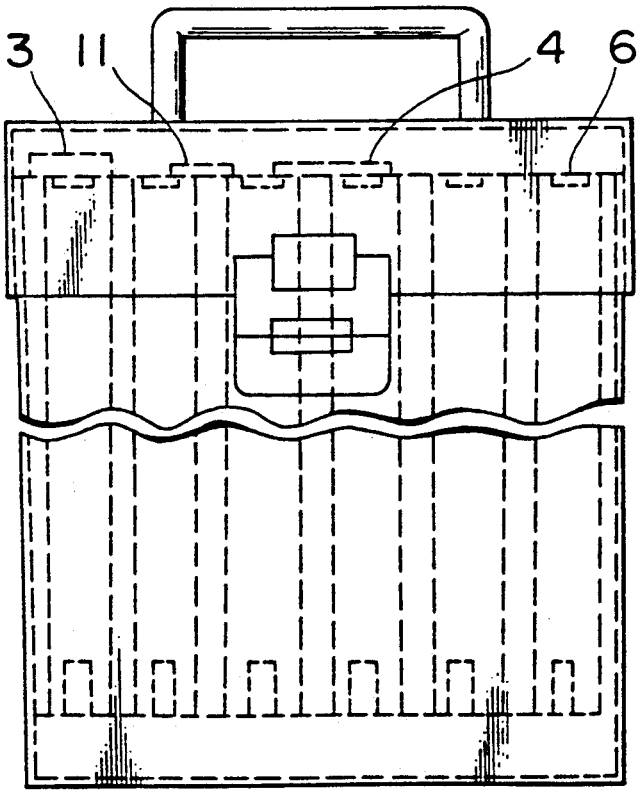
FIG. 2 is a front view thereof.
Figure 3:
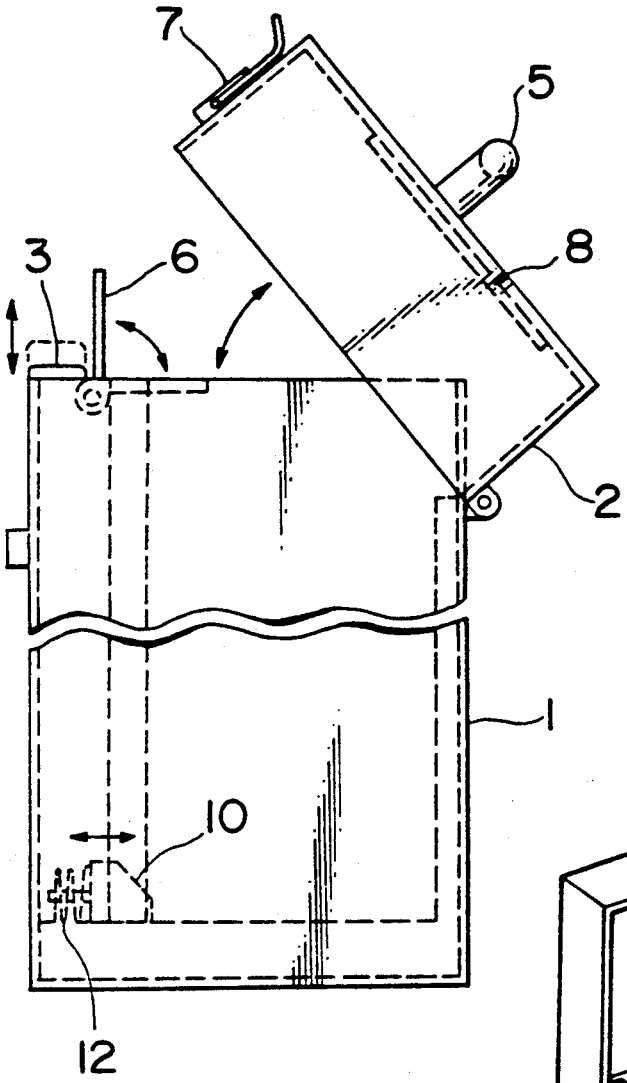
FIG. 3 is a side view thereof.
Figure 4:
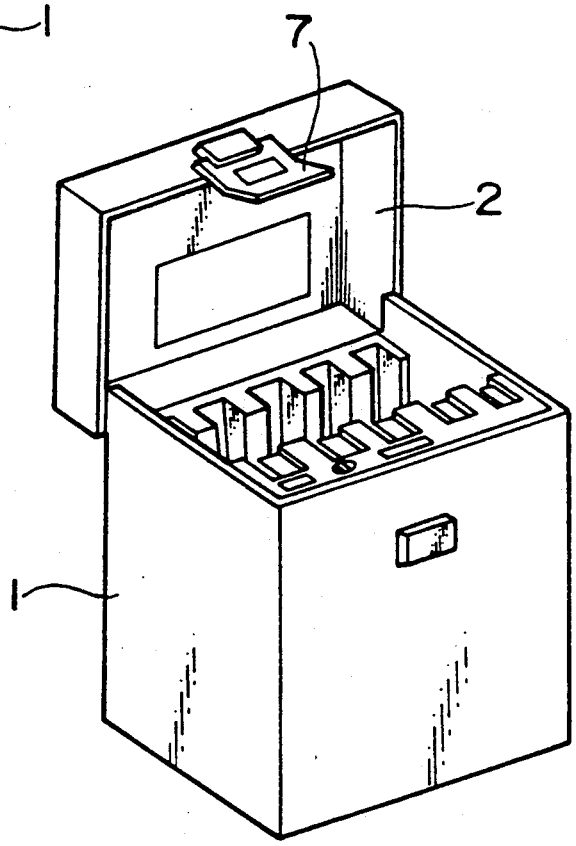
FIG. 4 is a perspective view showing the appearance thereof.

In the storage space of the body 1, as shown in FIG. 1, division plates 9A and 9B having a horizontal cross-sectional concavo-convex structure are arranged in opposite positions to each other, and the spaces between these concaves and convexes form storage parts S respectively. In the vicinity of the inner bottom side of each storage part S, as shown in FIG. 3, a switch 10 is provided, which functions to the storage part S as a sensor energized by a spring 12, an ON-signal is output responding to the take-out of a video cassette V from the storage part S.

A holding stopper 6 is provided above the division plate 9B, thereby preventing the video cassettes V stored in the storage parts S from slipping out of the storage parts S. The upper side of said division plate 9B functions as a display panel with the upper lid 2 opened, and a take-in and take-out button 3, a take-in and take-out indicator 4, an indicator change-over key mechanism 11 and others are mounted thereon.

This indicator change-over key mechanism 11 can be operated when a rental agent has inserted a particular key therein, wherein not only such a mechanical key structure, but also a card type key, a card type key of magnetic stripe structure and an IC-card type key may be also used.

The take-in and take-out button 3, not shown in detail, is interlocked with said holding stopper 6, and the holding mechanism of the stopper 6 is released by pushing the take-in and take-out button 3, thereby making it possible to take out the video cassettes V in the storage parts S.

Said take-in and take-out indicator 4 may indicate numeric values digitally for example by means of a 7-segment systems or may indicate numeric values mechanically with a count meter or the like. This take-in and take-out indicator 4 is incorporated with an unshown counter interlocked with said switch 10, and every time an ON-signal of the switch 10 from one of the storage parts S is detected, the count value is incremented by "1". Among the ON-signals from the same storage part S only the first one is latched so that no count is taken more even if the take-in and take-out of video cassettes V from this storage part S is repeated.

Said take-in and take-out indicator 4 takes count every time one of the video cassettes V is taken out, and does not record which video cassette a renter has taken out, thereby protecting privacy of renters.

The indicator change-over key mechanism 11 having the object of changing the indication modes of said take-in and take-out indicator 4 can indicate not only the number of stored video cassettes in initial installation condition and the number of rented video cassettes, but can also reset the take-in and take-out indicator 4. However, this key mechanism 11 is operable only with a rental key managed by a rental agent.

[Embodiment 2]

Figure 5:
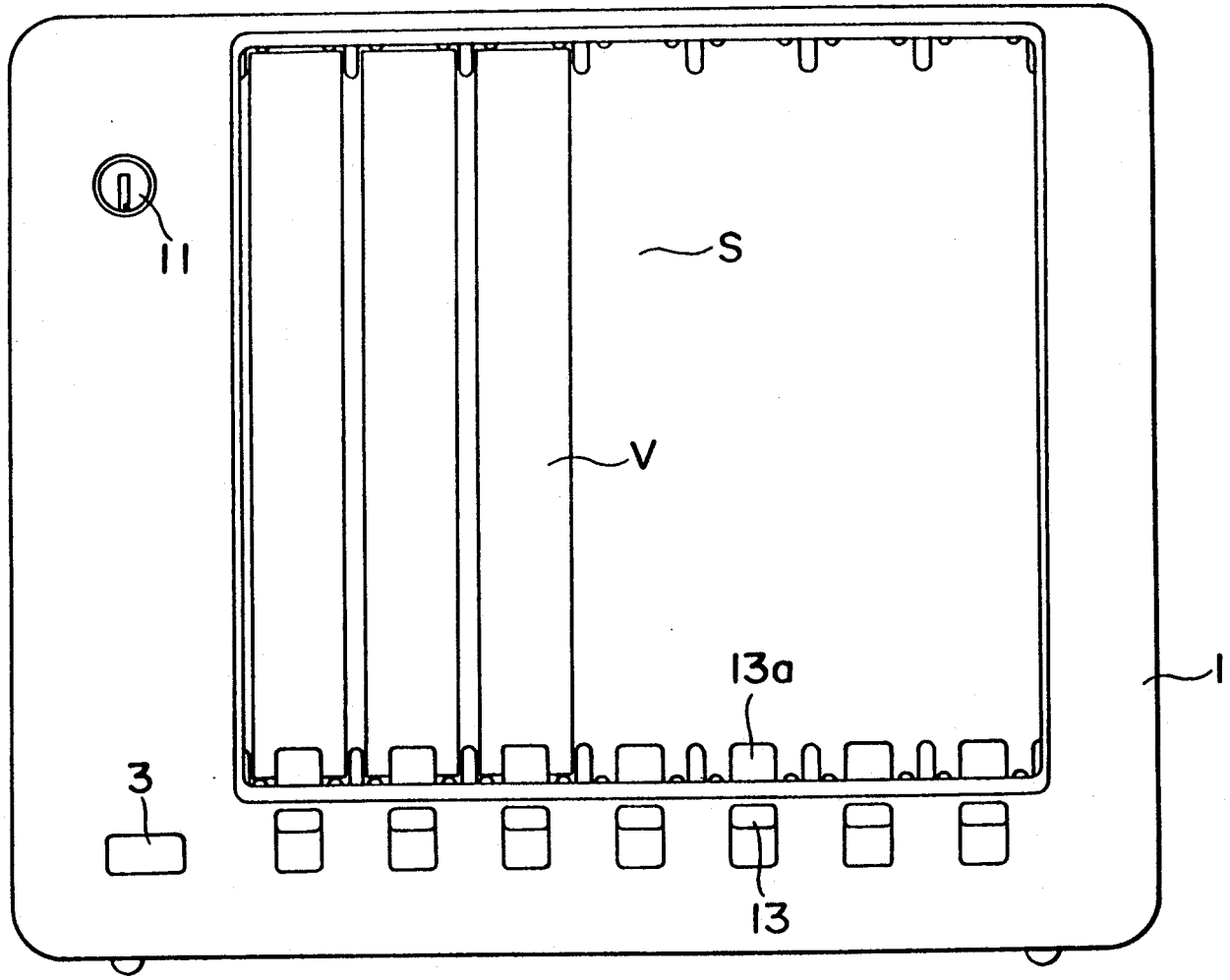
FIG. 5 is a plan view showing the preferred embodiment 2 according to the present invention.

The body 1 of the storage case according to Embodiment 2 has, as shown in FIG. 5, storage parts S capable of storing 7 video cassettes, and on the body 1 a selector button 13 is mounted respectively in the vicinity of said storage parts for seven video cassettes.

Figure 6:
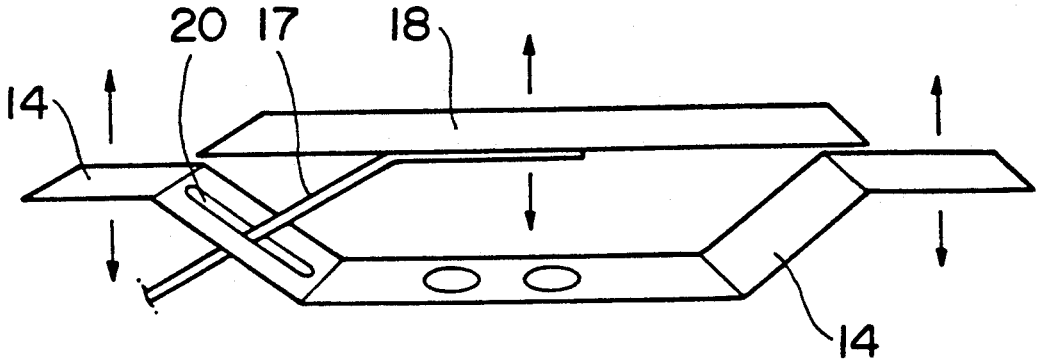
FIG. 6 is a schematic view showing the mechanism in the vicinity of the sensors.

Said selector button 13 is provided with a claw-like stopper 13*a* projecting towards the storage part S so as to energize the video cassette energized upwards in of FIG. 6 with energizing effect of an ejecting spring 14. The selector button 13 is mounted so as to be energized upwards in FIG. 5, that is towards the storage part S, and in a normal condition it holds the tip of the video cassette V energized with said ejecting spring 14.

On the bottom of the storage part S a sensor probe 17 acting as a count switch terminal is mounted together with the screwed ejecting spring 14. This sensor probe 17 is energized upwards by a coil spring or the like (not shown) the both ends of which are energized in an expanding direction. Said ejecting spring 14 is composed of an elastic leaf spring, which is, as shown in FIG. 6, provided with a guide slit partially, and a moving sensor probe 17 is guided along this guide slit. The tip of said sensor probe 17 is shielded with a plate-like cover 18. In this embodiment, as described above, the sensor probe 17 and the ejecting spring 14 are shielded with the cover, thereby preventing mischief or the like.

In the following, the detection of taken out video cassettes V with said sensor probe 17 will be described.

Figure 7A:
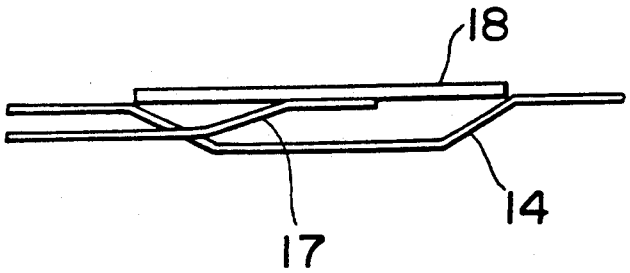
FIG. 7 (*a*) and (*b*) are views describing the operations of the sensors.
Figure 7B:
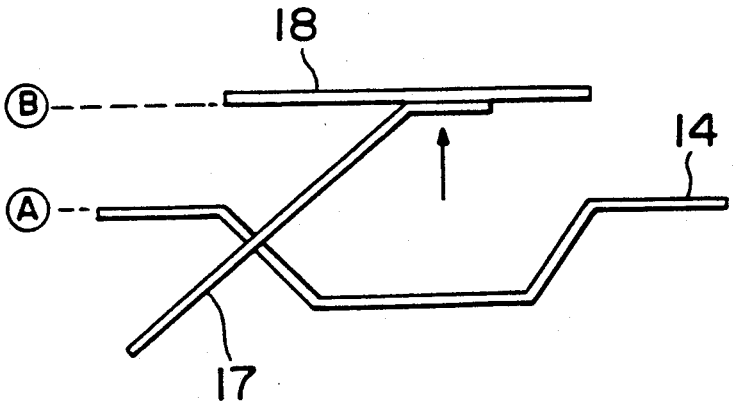
Figure 8:
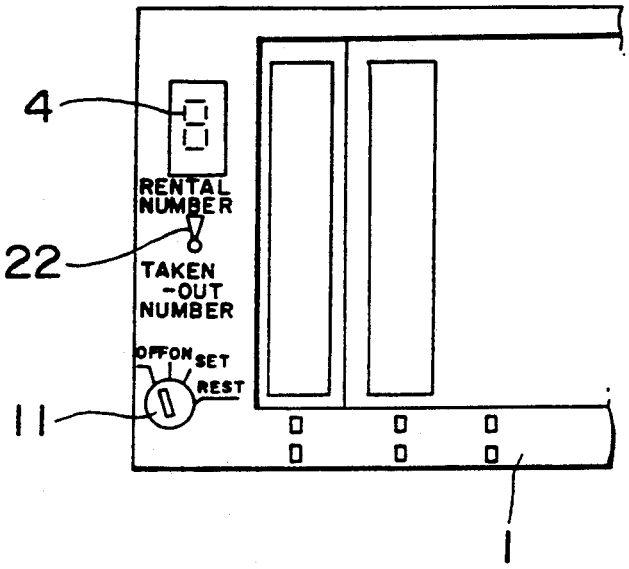
FIG. 8 is a plan view showing the preferred embodiment 3 according to the present invention.

First, when a video cassette V is stored in the storage part S, the ejecting spring 14 and the sensor probe 17 are so positioned to each other as shown in FIG. 7(*a*). Without referring now in detail, they are linked with the take-in and take-out button 3 mechanically or electronically so that the selector button 13 can not be slided without pushing the take-in and take-out button 3. In order to realize such a mechanism, for example, a mechanical lock function may be provided wherein the selector button 13 can be slided only when the take-in and take-out button 3 is pushed in, or a well-known electronic mechanism such as electromagnetic lock or the like may be used.

When the selector button 13 is slided downwards in FIG. 5 with the take-in and take-out button 3 being pushed in, the stopper 13*a* holding the video cassette V is released, and the video cassette V is moved in an energizing direction with energizing effect of the ejecting spring 14.

Thus, the bottom face of the video cassette V reaches the position A in FIG. 7(*b*), that is, reaches the highest point (dead point) on the ejecting spring 14. Accordingly, the tip of the sensor probe 17 reaches also the position A, however, no take-out detecting signal is generated yet in this condition. At this time the top side of the video cassette V is projected by a predetermined amount above the upper side of the body 1, and it is therefore easy to confirm the content of the video cassette V by applying a label or the like on which the recorded content or the like described on the side of the projected part of the video cassette V.

When the renter decides to rent the video cassette V based on the confimation of said content thereof, the video cassette V is drawn out more upwards. Only when it is drawn out by a predetermined amount from said position A, that is, to the position B in the same figure, the taken out video cassette V is detected with the sensor probe 17, and a detection signal is sent out.

In this embodiment, as described above, the renting will of renters can be confirmed more clearly not only with the take-in and take-out button 3 and the selector button 13 interlocked with each other, but also with the sensor probe 17 generating a detection signal only when a video cassette V is drawn out to a predetermined amount.

[Embodiment 3]

In this embodiment, not only the take-in and take-out indicator 4 and the key mechanism 11, but also a mode switch 22 changing the indication between the number of taken out and rented video cassettes is provided on the upper side of the body 1. The function of this mode switch 22 will be described later.

Figure 9:
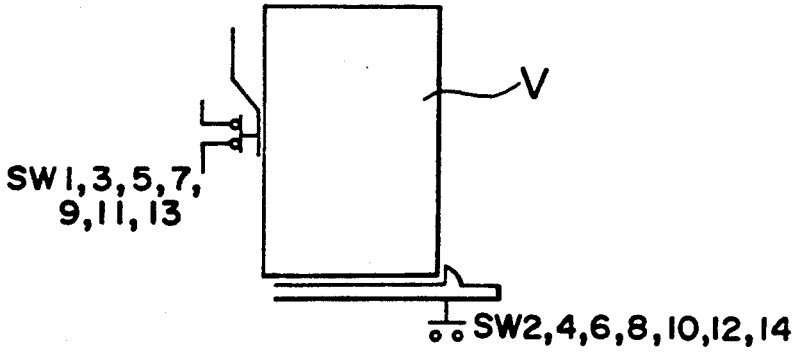
FIG. 9 is a schematic view showing the arrangement of the two systems of the sensors.

This embodiment is characterized in that each storage part S is provided with two sensors. As shown in FIG. 9, the first sensoors (SW1, 3, 5, 7, 9, 11, 13) detect a taken out video cassette V, and are provided with a similar function to that of the sensor probe 17 described in Embodiment 2. That is, the first sensors maintain "OFF" condition when a video cassette V is stored, and turn to "ON" only when a taken out video cassette V is detected. The second sensors (SW2, 4, 6, 8, 10, 12, 14) count the total number of video cassettes V stored in the storage case in an initial condition, and "ON" when video cassettes V are stored in the storage case.

Figure 10:
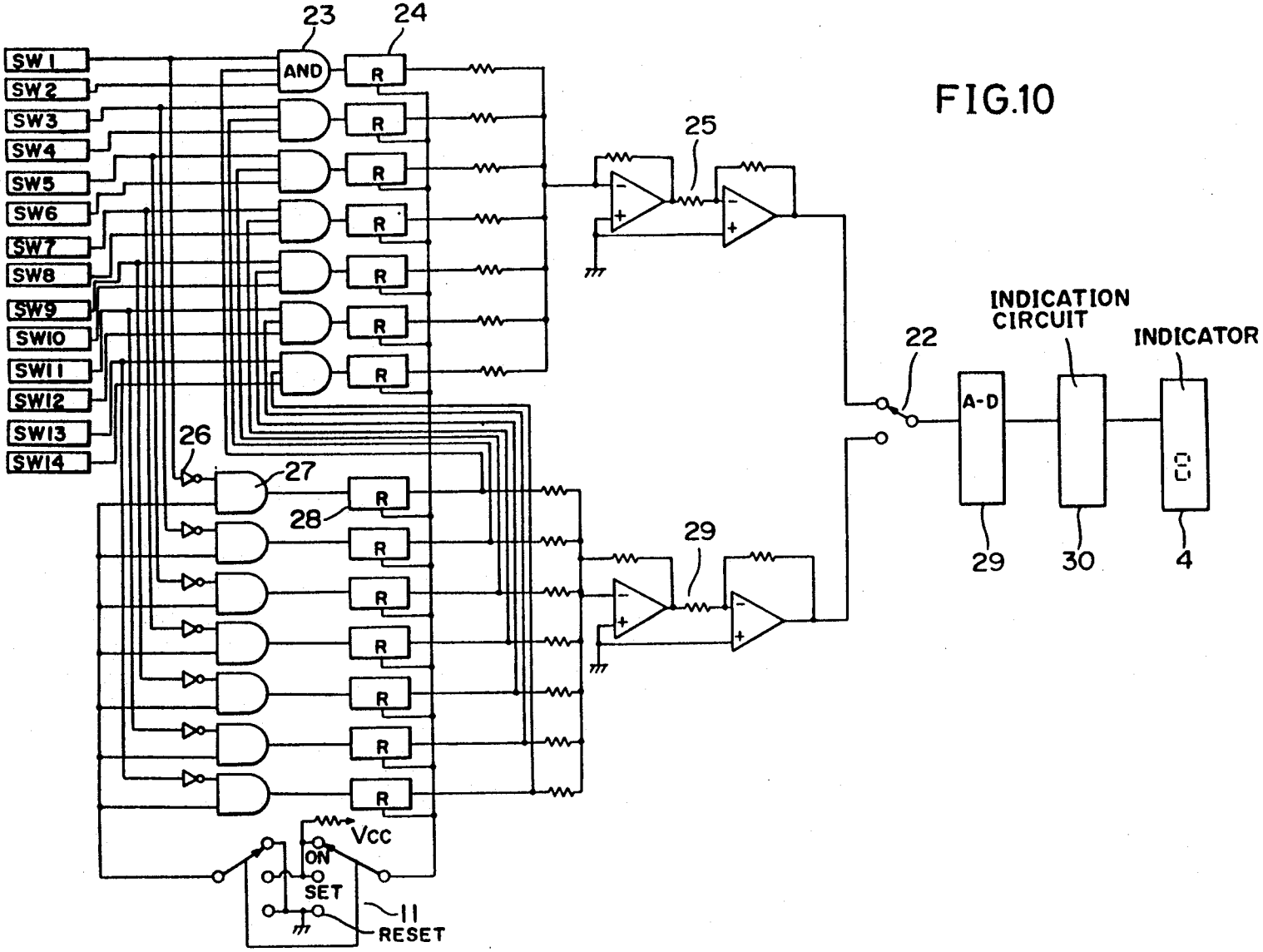
FIG. 10 is a block diagram showing the circuit compositions of the sensor systems.

Signals detected from said first and second sensors are processed in a circuit configuration shown in FIG. 10.

This circuit comprises a take-out detecting circuit and a rental video cassette storage number detecting circuit, and the former is composed of an AND gate of 3-inputs 23, a latch circuit 24 and an addition circuit 25. The latch circuit included here has a function of maintaining the output from the AND gate 23 by inputting "1" to the latch input R.

The latter rental video cassette storage number detecting circuit is composed of an inverter 26, an AND gate 27 of 2-inputs, a latch circuit 28 and an addition circuit 29.

The output from said first sensors are inputted not only to the AND gate 23, but also to the AND gate 27, being inverted with the inverter 26.

In said circuit configuration, after a necessary number of video cassettes V have been stored in the storage parts S as a prerental storage, the indication change-over key mechanism 11 is turned to "RESET" position. Thus the segment indication of the indicator 4 is now "0".

Subsequently, after the indication change-over key mechanism 11 has been turned to "SET" position, the mode switch 22 is turned to "Rental Number" side. As a result of these operations the latch circuits 24 and 28 are now in latch mode. Since the first sensors of the storage parts storing video cassettes V are put to "OFF" condition, the outputs from said first sensors are now "0", and these "0" outputs are inverted to "1" with the inverter 26, and are inputted to one terminal of the AND gate 27. At this time Vcc or "1" is impressed on the other terminal of the AND gate 27 because of SET mode of the key mechanism 11, and the gate is open, hence the AND gate 27 outputs "1" to the latch circuit 28. The addition circuit 29 adds the "1" outputs from said latch circuit 28 with a predetermined clock cycle, and outputs the added values to an A/D converter circuit 28 by way of the mode switch 22 turned to "Rental Number" side. After this A/D conversion a numeric value corresponding to the storaged number is indicated segmentary on the indicator 4 by way of an indication circuit 30.

Then the key mechanism 11 is put to "ON" mode, and an unshown key is drawn out. Now the storage case is ready for rental as a whole. Even if the key mechanism 11 is turned from "SET" to "ON" mode, the latching function of the latch circuits 24 and 28 is retained, and the "1" output from the latch circuit 28 is maintained.

Subsequently, in an initial condition wherein the storage case has been just installed at the renter, the renter can always confirm the storage number (rental number) and the taken-out number (initial value is "0") by changing over the mode switch 22.

When a stored video cassette V is drawn out from one of the storage parts S, the first sensor of this storage part S, for example SW1, detects this, thereby changing the output of SW1 from "0" to "1". Since the input of "1" from the latch circuit 28 is maintained in the AND gate 23, and "1" is also outputted from SW2, an AND logic holds good, thereby outputting "1" from the AND gate 23 to the latch circuit 24. Since a latch condition is maintained from the time of said "SET" mode in the latch circuit 24, the "1" output from the AND gate 23 is outputted as it is, thereby incrementing the addition circuit 25. Even if video cassettes V are stored again in the storage parts S, changing the output of SW1 from "1" to "0", the latch circuit 24 continues to maintain the output of "1".

As a result thereof, this embodiment makes it possible to ensure a very easy comparison between the rental and taken-out number, to prevent an error-count of the rental number due to malfunction of the sensors of the storage parts no video cassettes are stored in an initial installation condition, and to improve the reliability of rental management.

While the invention made by the inventor has been described concrete with reference to particular embodiments thereof, it is to be understood that the present invention is not limited to said embodiments and that changes and modifications may be made within the scope to the abstract thereof.

For example, in Embodiments 1 to 3, only characteristic points thereof have been described, however, it goes without saying that combinations of these embodiments may be used. Said embodiments have been all applied to video cassettes, however, there are no doubts that they may be also applied to CDs.

What is claimed is:

1. A storage case comprising a case body having two or more storage parts into which CDs or recorded video cassettes are inserted respectively, sensors having sensor probes to detect said CDs or said video cassettes taken out from said storage parts, a counter integrated by signals from these sensors, and an indicator part indicating an integrated value from this counter characterized in that an ejecting means is provided in said storage parts which energizes said CDs or said video cassettes in the direction of the upper side, that a signal is outputted by a tip of the probe of said sensor when said video cassette has been taken out by a predetermined amount from the highest point in the direction of the upper side, and that said ejecting means and said probe are shielded with a cover mounted on the tip of the probe.

2. A storage case as described in claim 1 which is characterized in that said sensors in said storage parts comprise a first sensor detecting said CDs or said video cassettes taken out from a stored condition, and a second sensor detecting a rental storage number of the CDs or the video cassettes stored in an initial condition, and that the counter is integrated using the logical multiple of a latch signal based on a storage detecting signal from said second sensor and a take-out detecting signal from said first sensor.

* * * * *